US009724732B2

(12) United States Patent
Moon et al.

(10) Patent No.: US 9,724,732 B2
(45) Date of Patent: Aug. 8, 2017

(54) SCREEN CLOTH FOR VIBRATING, ROTATING OR STATIONARY SCREENS

(71) Applicant: SYNCRUDE CANADA LTD. in trust for the owners of the Syncrude Project as such owners exist now and in the future, Fort McMurray (CA)

(72) Inventors: Soon Won Moon, Edmonton (CA); Khaled Obaia, Edmonton (CA); Damien Reid, Edmonton (CA)

(73) Assignee: SYNCRUDE CANADA LTD., Fort McMurray (CA), in trust for the owners of the Syncrude Project as such owners exist now and in the future ( * ) Notice: Subject to any disclaimer, the term of this patent is extended or adjusted under 35 U.S.C. 154(b) by 0 days.

(21) Appl. No.: 14/818,057

(22) Filed: Aug. 4, 2015

(65) Prior Publication Data

US 2016/0038976 A1 Feb. 11, 2016

Related U.S. Application Data

(60) Provisional application No. 62/033,238, filed on Aug. 5, 2014.

(51) Int. Cl.

| | |
|---|---|
| ***B07B 1/49*** | (2006.01) |
| ***B07B 1/46*** | (2006.01) |
| ***B07B 1/28*** | (2006.01) |

(52) U.S. Cl.

CPC ..... *B07B 1/4672* (2013.01); *B07B 1/28* (2013.01); *B07B 1/469* (2013.01); *B07B 1/4618* (2013.01)

(58) Field of Classification Search

CPC ..... B07B 1/28; B07B 1/4618; B07B 1/4672; B07B 1/469

USPC ..... 209/392, 397

See application file for complete search history.

(56) References Cited

U.S. PATENT DOCUMENTS

| | | | | |
|---|---|---|---|---|
| 1,718,385 A * | 6/1929 | Sherwood | B07B 1/4672 139/425 R |
| 3,640,760 A | 2/1972 | Nichols, Jr. | |
| 3,943,054 A | 3/1976 | Simonson | |
| 4,313,992 A | 2/1982 | Spiewok | |
| 4,832,834 A | 5/1989 | Baird, Jr. | |
| 5,944,197 A * | 8/1999 | Baltzer | B01D 46/10 209/400 |

(Continued)

FOREIGN PATENT DOCUMENTS

| | | |
|---|---|---|
| CA | 2524540 | 5/2006 |
| CA | 2645317 | 5/2010 |

(Continued)

*Primary Examiner* — Terrell Matthews

(74) *Attorney, Agent, or Firm* — Bennett Jones LLP

(57) ABSTRACT

A screen cloth for use in a screening device for screening out oversize objects in a material flowing in a direction is provided, comprising a metal plate having a perimeter and comprising a plurality of openings therethrough and forming a grid having longitudinal ligaments substantially parallel to the direction of the material flow and transverse ligaments substantially perpendicular to the direction of the material flow, the metal plate having an impact surface and a bottom surface; a coating or liner comprising an elastomer, coating or lining at least the impact surface of the metal plate or a portion thereof; and a wear material at least partially embedded into the elastomer coating or liner, or a portion thereof.

20 Claims, 5 Drawing Sheets

(56) References Cited

U.S. PATENT DOCUMENTS

| | | | | |
|---|---|---|---|---|
| 6,736,271 | B1 * | 5/2004 | Hall | B07B 1/4618 209/315 |
| 8,281,933 | B2 | 10/2012 | Gronvall et al. | |
| 8,312,996 | B2 * | 11/2012 | Bakula | B07B 1/46 209/392 |
| 8,919,567 | B2 * | 12/2014 | Tieu | B07B 1/4609 209/392 |
| 2009/0173595 | A1 | 7/2009 | Burstrom | |
| 2010/0272952 | A1 * | 10/2010 | Hukki | B07B 1/4618 428/137 |
| 2013/0026080 | A1 | 1/2013 | Mohanka | |

FOREIGN PATENT DOCUMENTS

| | | |
|---|---|---|
| CA | 2689771 | 7/2010 |
| CN | 201012359 | 1/2008 |

* cited by examiner

SCREEN CLOTH FOR VIBRATING, ROTATING OR STATIONARY SCREENS

FIELD OF THE INVENTION

The present invention relates generally to stationary or vibrating screening devices. In particular, a screen cloth useful in stationary, rotating and/or vibrating screens for screening oversize objects in a material is provided which has a coating or liner comprising an elastomer, and a wear material, which protect the impact screen cloth against damage from the material to be screened.

BACKGROUND OF THE INVENTION

Vibrating, rotating and/or stationary screens are used in the oil sand industry, in particular, in oil sand slurry preparation plants. Oil sand, such as is mined in the Fort McMurray region of Alberta, generally comprises water-wet sand grains held together by a matrix of viscous bitumen. It lends itself to liberation of the sand grains from the bitumen by mixing or slurrying the oil sand in water, allowing the bitumen to move to the aqueous phase.

As-mined or pre-crushed oil sand is generally mixed with warm or hot water to yield an oil sand slurry. The slurry is then conditioned in a hydrotransport pipeline and subsequently introduced into a large, open-topped, conical-bottomed, cylindrical vessel commonly termed a primary separation vessel (PSV) where the more buoyant aerated bitumen rises to the surface and forms a bitumen froth layer.

It may be desirable to remove the larger aggregates present in oil sand slurry prior to pipelining in order to avoid blockage or damage of downstream equipment, e.g., pump component wear. Thus, vibrating, rotating and/or stationary screens may be used at various points during slurry preparation to reject larger lumps of oil sand, rocks and other aggregates, which are large enough to block or damage downstream equipment, prior to pipeline conditioning. Screens may also be used to further screen oil sand tailings slurry prior to treating/disposing same.

However, oil sand slurry is extremely heavy and abrasive due to the large amount of sand, gravel and crushed rock contained therein. Further, in particular with primary vibrating screens, these screens are generally vibrating with an acceleration of approximately 4-5 g, so that all oil sand slurried material passes over and through the screen cloths of the vibrating screen. This results in the rapid spalling and eventual wearing through of the screen cloths of the vibrating screen ("hole-throughs"), which can lead to production interruption and an unplanned maintenance event.

Various types of screen cloths are currently used. Hard-faced screen cloths such as tungsten carbide overlays provide excellent resistance against abrasion wear, but often prematurely fail due to impact and fatigue damage. Elastomer-lined screen cloths exhibit improved wear performance due to their energy-dampening capability through elastic deformation; however, when the impact energy of oversize reject material is beyond the elastic capability of the elastomers, tearing or gouging occurs. Despite the availability of different types of screen cloths, poor wear capability and plugging remain persistent problems in screening.

Thus, it is desirable to have an improved screen cloth that can withstand the abrasiveness of oil sand slurry.

SUMMARY OF THE INVENTION

It was discovered that screen cloths of vibrating, rotating and/or stationary screening devices used to screen frozen lumps, rocks and the like from oil sand slurry were wearing through much quicker than desired due to the abrasive nature of the slurry. In particular, it was discovered that screen cloths of vibrating screening devices were suffering from localized wear phenomena resulting from the slurry flow distribution.

The current application is directed to an improved screen cloth and method of screening an oil sand slurry having oversize reject material using the improved screen cloth. It was surprisingly discovered that by using the screen cloth of the present invention, one or more of the following benefits may be realized:

(1) The screen cloth includes structural metal, a coating or liner comprising an elastomer coating or lining the structural metal, and a wear material at least partially embedded into the elastomer coating or liner. The wear material and elastomer together form a protective surface which can protect the structural metal from the abrasiveness of the oil sand slurry.

(2) The elastomer provides resistance against wear and corrosion.

(3) The wear material protects the elastomer from tearing or gouging at high impact and impingement areas.

(4) The elastomer coating or liner provides an energy dampening function, reducing the net energy imparted onto the wear material at least partially embedded into the elastomer coating or liner from the impact of oversize reject material and thereby reducing the risk of premature failure of the wear material.

Use of the present invention extends the running time of a vibrating, rotating and/or stationary screening device so that the operator does not have to shut down the screening device as frequently to replace the screen cloth.

Thus, broadly stated, in one aspect of the present invention, a screen cloth for use in a screening device for screening out oversize objects in a material flowing in a direction is provided, comprising:

- a metal plate having a perimeter and comprising a plurality of openings therethrough and forming a grid having longitudinal ligaments substantially parallel to the direction of the material flow and transverse ligaments substantially perpendicular to the direction of the material flow, the metal plate having an impact surface and a bottom surface;
- a coating or liner comprising an elastomer, coating or lining at least the impact surface of the metal plate or a portion thereof; and
- a wear material at least partially embedded into the elastomer coating or liner, or a portion thereof.

In one embodiment, the wear material is embedded into the elastomer coating or liner at at least one high impact area of the impact surface of the screen cloth. In another embodiment, the high impact area is a portion of the transverse ligaments extending between side by side longitudinal ligaments. In another embodiment, the high impact area is a leading edge of the portion of the transverse ligaments extending between side by side longitudinal ligaments.

In one aspect of the present invention, a screen for use in a vibrating, rotary or stationary screening device for screening oversize objects in a material is provided, comprising:

a plurality of screening rows positioned end to end between the feed end and the discharge end of the screen, each screening row comprising one or more of the above screen cloths.

In yet another aspect of the present invention, a method for screening an oil sand slurry having oversize reject material is provided, comprising:

providing a screen having a number of screen cloths, each screen cloth comprising a metal plate having a perimeter and comprising a plurality of openings therethrough and forming a grid having longitudinal ligaments substantially parallel to the direction of the material flow and transverse ligaments substantially perpendicular to the direction of the material flow, each metal plate having an impact surface and a bottom surface; a coating or liner comprising an elastomer, coating or lining at least the impact surface of the metal plate or a portion thereof; and a wear material being at least partially embedded into the elastomer coating or liner, or a portion thereof; and feeding the oil sand slurry onto the screen so that the slurry flows in the direction of the longitudinal ligaments and allows the oversize reject material to pass over the screen cloth.

Other features will become apparent from the following detailed description. It should be understood, however, that the detailed description and the specific embodiments, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

Referring to the drawings wherein like reference numerals indicate similar parts throughout the several views, several aspects of the present invention are illustrated by way of example, and not by way of limitation, in detail in the following figures. It is understood that the drawings provided herein are for illustration purposes only and are not necessarily drawn to scale.

DESCRIPTION OF THE PREFERRED EMBODIMENT

The detailed description set forth below in connection with the appended drawings is intended as a description of various embodiments of the present invention and is not intended to represent the only embodiments contemplated by the inventor. The detailed description includes specific details for the purpose of providing a comprehensive understanding of the present invention. However, it will be apparent to those skilled in the art that the present invention may be practiced without these specific details.

The present invention relates generally to an improved screen cloth and method of screening an oil sand slurry having oversize reject material using the improved screen cloth.

Figure 1A:
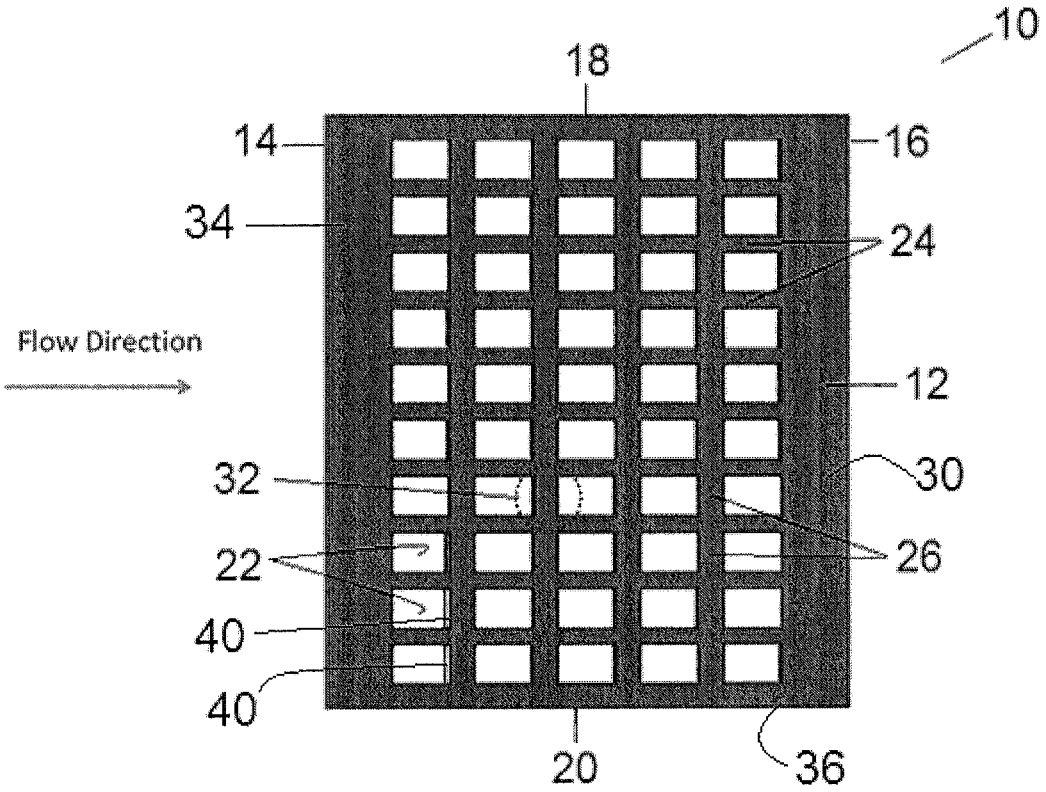
FIG. 1*a* is a general schematic of a screen cloth comprising a metal plate coated or lined with a coating or liner comprising an elastomer.

FIG. 1*a* is a general schematic of a screen cloth having an elastomer coating. Screen cloth 10 is formed of a perforated plate 12 having a front edge (material or feed end) 14, a back edge (oversize exit end) 16, a first side edge 18, and a second side edge 20. Openings 22 in the perforated plate 12 are generally of a consistent size, wherein the size is dependent on the size of the oversize that one desires to screen out. In this embodiment, the openings 22 are rectangular. Screen cloth 10 further comprises an impact surface 34 (or top surface) and a bottom surface 36.

The perforated plate 12 can be made of a number of different materials, preferably, steel or any other suitable metal. In one embodiment, perforated plate 12 is constructed from a large piece of steel, which forms the perimeter of the screen cloth 10, and a regular pattern of openings 22 or holes are cut and/or punched (flame, plasma) therethrough to form the mesh of the perforated plate 12 which also comprises longitudinal ligaments 24 and transverse ligaments 26.

In FIG. 1*a*, the perforated plate 12 has been coated with a coating comprising an elastomer, referred to herein as elastomer coating 30, on both the impact surface 34 and the bottom surface 36. This is shown more clearly in FIG. 1*b*. It is understood, however, that in some embodiments of the present invention, only the impact surface 34 or a portion of impact surface 34 needs to be coated or lined with a coating or liner comprising and elastomer.

Figure 1B:
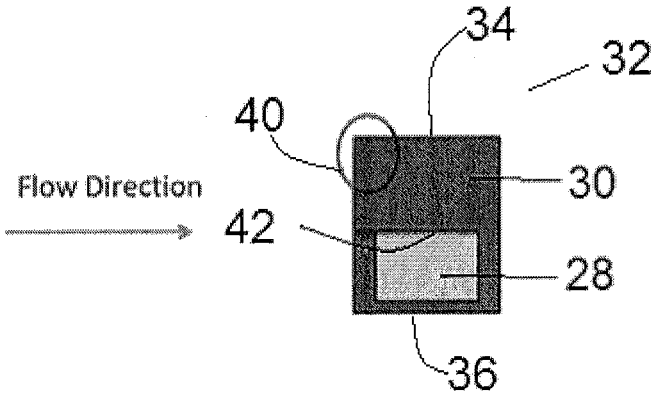
FIG. 1*b* shows a side view of a portion of the screen cloth of FIG. 1*a*.

It can further be seen from FIG. 1*a* that the direction of flow of oversize reject material to be screened is from front edge 14 to back edge 16. The hatched circle shown in FIG. 1*a* shows an area of the screen cloth 10 which has been observed to receive a high degree of impact or impingement from the oversize reject material to be screened and, thus, wears quicker than some other areas of the screen cloth 10. This area relates to the portion of the transverse ligaments 26 that is located between two side by side longitudinal ligaments 24 (hereinafter referred to as high impact area 32). FIG. 1*b* shows a side view of high impact area 32 of the screen cloth 10.

As can be seen in FIG. 1*b*, the structural metal 28 forming the perforated plate 12 is encapsulated with elastomer coating 30, with the elastomer coating 30 being thicker on the impact surface 34, which surface is more prone to wear from the flow of material, than on the bottom surface 36. It was found that the highest impact and impingement portion of high impact area 32 was the leading edge 40, as indicated by circle FIG. 1*b*, relative to the flow direction, i.e., the leading edge 40 of the portion of the transverse ligaments 26 located between the longitudinal ligaments 24, as shown in FIG. 1*a*. It was discovered that elastomer coating 30 located at leading edge 40 is subject to tearing or gouging by the flow of material. Repetitive impacts from the material can cause high shear stress at the interface 42 between the elastomer coating 30 and the structural metal 28.

It is understood that the elastomer coating can be coated onto the structural metal of the perforated plate by any means known in the art. Similarly, the elastomer liner can be deployed onto the structural metal of the perforated plate by any means known in the art. It is further understood that the application of the coating/liner is dependent on the coating/liner material. In some cases, the coating is poured as liquid, allowed to set and then cured in an oven. In other cases, liner is applied as layers or sheets of raw material and baked in an oven. In further cases, the coating is sprayed and cured. The wear material is typically positioned in the mold during or after placing the coating/liner. Special preparation of the wear material surface allows for strong bonding between the two different materials. In some cases, special mechanical anchors are used to position and secure the wear material.

It was surprisingly discovered that reinforcing the leading edges (relative to the flow of the material) of the portion of the transverse ligaments located in between the longitudinal ligaments by at least partially embedding a wear material into the elastomer coating or liner at the leading edge protected the elastomer coating or liner from wear and from potentially tearing or gouging due to the impact of oversize reject material. Further, the fact that at least part of the elastomer coating or liner may now be sandwiched between the structural metal and the wear material, provides an additional energy dampening function to the screen cloth.

As used herein, the term "wear material" means a material which is abrasion resistant. Wear material 234 may include, but is not limited to, chromium carbide, tungsten carbide (PTA or Technoginia products) or cast wear products (ceramic, Kencast™ (tungsten carbide chips suspended in an all-steel matrix) or sintered tungsten carbide).

As used herein, the term "elastomer" means a material which exhibits the property of elasticity, namely the ability to deform when a stress is applied and to recover its original form (i.e., length, volume, shape, etc.) spontaneously when the stress is removed. Elastomers typically have a low Young's modulus (i.e., the ratio of stress to strain, expressed in units of pressure), and a high yield strain (i.e., the strain at which a material begins to deform plastically). Suitable elastomers include, but are not limited to, synthetic or natural rubbers, polyurethane, other thermosetting elastomers, and thermoplastic elastomers.

Figure 2:
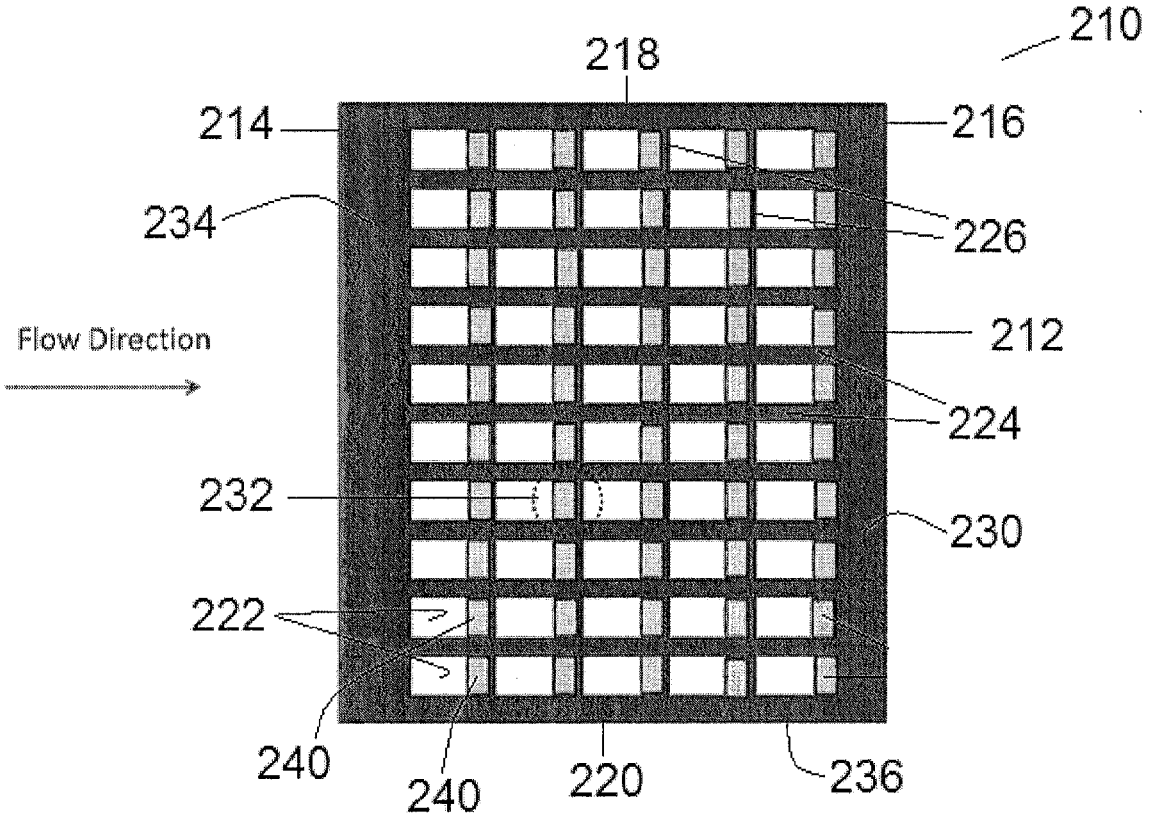
FIG. 2 shows one embodiment of a screen cloth of the present invention.

FIG. 2 illustrates one embodiment of a screen cloth 210 where the leading edges of the portion of the transverse ligaments located in between the longitudinal ligaments have been reinforced by embedding a wear material into the elastomer thereon. Screen cloth 210 comprises perforated plate 212 having a front edge 214 (material or feed end), a back edge 216 (oversize exit end), a first side edge 218, and a second side edge 220. In this embodiment, openings 222 in perforated plate 212 are rectangular in shape and the size of the openings 222 is dependent on the size of the oversize that one desires to screen out. Generally, the openings 222 are of a consistent size.

Perforated plate 212 may be constructed from a large piece of steel, which forms the perimeter of the screen cloth 210. The openings 222 are cut and/or punched (flame, plasma) therethrough to form the mesh comprising longitudinal ligaments 224 and transverse ligaments 226. The longitudinal ligaments 224 are oriented substantially parallel to the direction of the material flow, extending essentially from the feed end 214 to the oversize exit end 216. The transverse ligaments 226 are oriented substantially perpendicular to the direction of the material flow, extending essentially from the first side edge 218 to the second side edge 220.

The perforated plate 212 has been coated with a coating comprising an elastomer, herein referred to as elastomer coating 230, either on the impact surface 234 only (or a portion thereof) or on both the impact surface 234 and the bottom surface 236. In this embodiment, leading edges 240 of the portions of the transverse ligaments 226 positioned in between the longitudinal ligaments 224 have been reinforced by embedding a wear material into the elastomer coating (or liner), as shown in FIGS. 3*a*-3*e*.

Figure 3A:
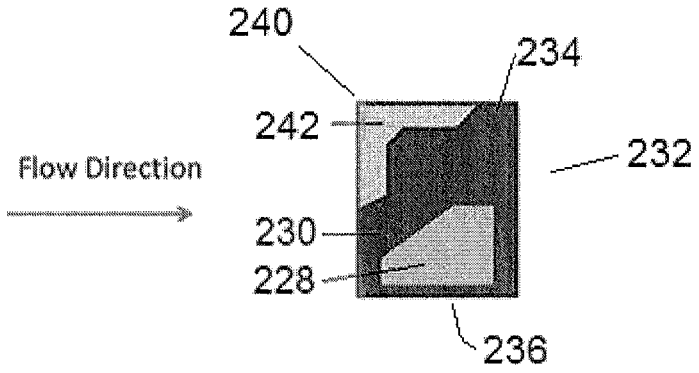
FIG. 3*a* is a schematic side view of a portion of the embodiment shown in FIG. 2.

FIG. 3*a* is a schematic side view of an embodiment of a portion of a transverse ligament as shown in FIG. 2 (shown as the hatched circle in FIG. 2 and referred to herein as high impact area 232). Similarly, FIGS. 3*b*-3*e* are schematic side views of portions of additional embodiments of screen cloth 210 of the present invention. It is contemplated that the size (thickness), shape, and/or positioning of the wear material 242 and elastomer coating (or liner) 230 coating (or lining) the structural metal 228 may vary depending upon the particular embodiment of screen cloth 210.

Figure 3B:
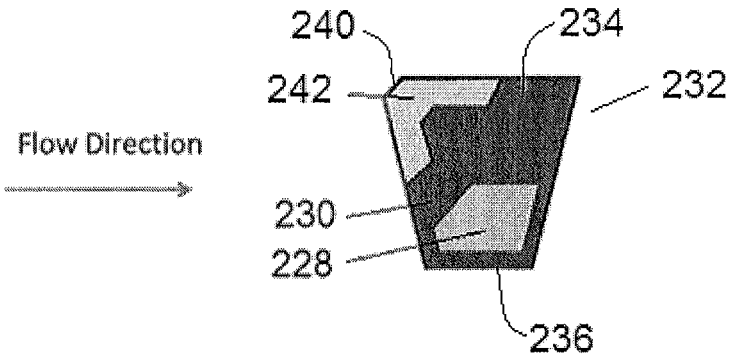
FIG. 3*b* is a schematic side view of a portion of an additional embodiment of a screen cloth of the present invention.

In one embodiment, the elastomer coating 230 encapsulates the entire structural metal 228 forming the perforated plate 212 to provide resistance against wear and corrosion (FIGS. 3*a*-*b*). Thus, both the impact surface 234 and bottom surface 236 are coated (or lined) with elastomer coating (or liner) 230. In one embodiment, the elastomer coating 230 coats a portion of the structural steel 228 forming the perforated plate 212. The structural steel 228 may be coated (or lined) with elastomer coating (or liner) 230 only on the impact surface 234 (FIGS. 3*c*-*d*), which surface is more prone to wear. In another embodiment, the structural steel is coated or lined with elastomer coating or liner only at the high impact areas which include the leading edge of the portion of the transverse ligaments located between the longitudinal ligaments as describe above.

Wear material 242 is embedded into elastomer coating (or liner) 230 or a portion thereof, e.g., the leading edge 240 or portion of the leading edge 240 which is an area of high impact and impingement, to protect elastomer coating (or liner) 230 from tearing or gouging at the high impact and impingement areas 240 (FIGS. 3*a*-*d*). In one embodiment, wear material 242 coats a portion of elastomer coating (or liner) 230 such that the wear material 242 covers at least the backside corner of the opening 222 (FIG. 2). In one embodiment, wear material 242 covers the entire perimeter of the opening 222.

Wear material 242 in various forms and shapes may be used; for example, wear material 242 may be in the form of a rod, cylinder, sphere, tile, insert, segment, or combinations thereof.

In one embodiment, wear material 242 may be in the form of one piece or multiple pieces of tiles, covering at least the backside corner of the opening 222.

Figure 3C:
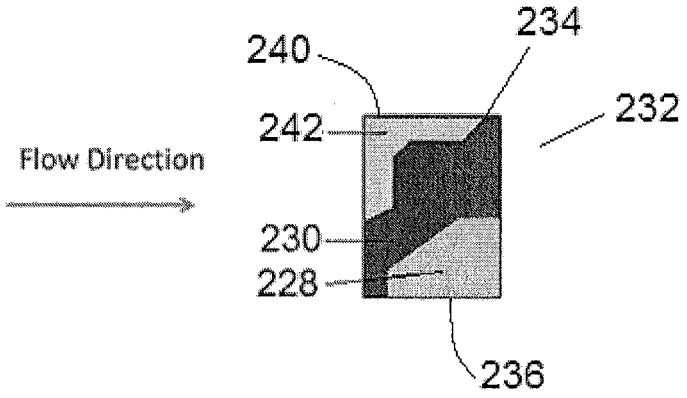
FIG. 3*c* is a schematic side view of a portion of an additional embodiment of a screen cloth of the present invention.
Figure 3D:
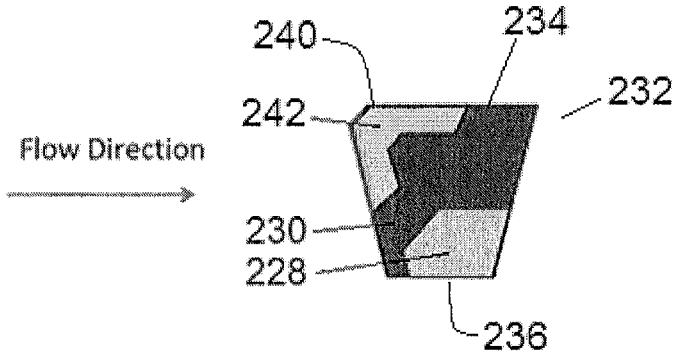
FIG. 3*d* is a schematic side view of a portion of an additional embodiment of a screen cloth of the present invention.

In one embodiment, wear material 242 may be in the form of one piece or multiple pieces of L- or C-shaped segments to cover at least the backside corner of the opening 222. It will be appreciated by those skilled in the art that the size and shape of the structural metal 228 forming the perforated plate 212, and the openings 222 may vary for example, to facilitate the passage of oversize reject material. In one embodiment, the openings 222 may tilt outwards from top or impact surface 234 to bottom surface 236 (FIG. 3*b*). In one embodiment, the openings 222 may be enlarged by having the elastomer 230 coated or lined only a side of the structural steel 228 which is prone to wear (FIGS. 3*c*-3*d*).

In one embodiment, the corner of the structural metal 228 facing the feed flow may be machined out, to have thicker elastomer layer between the structural metal 228 and the wear material 242 and thereby achieving higher energy dampening function (FIGS. 3*a*-3*d*).

Figure 3E:
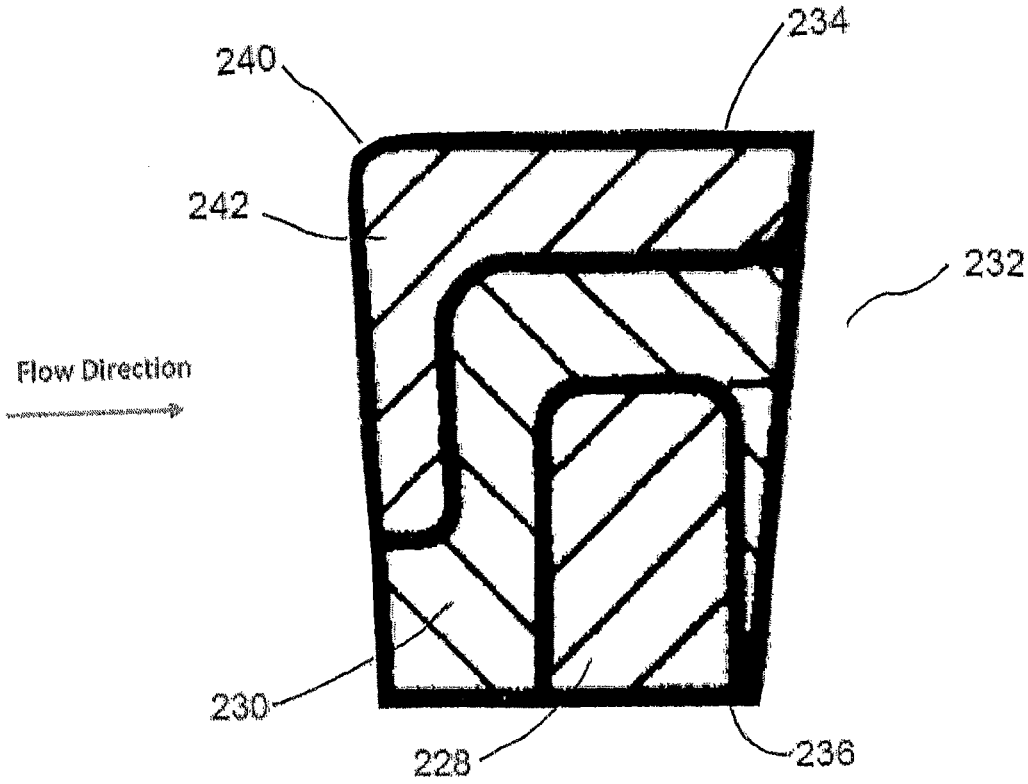
FIG. 3*e* is a schematic side view of a portion of an additional embodiment of a screen cloth of the present invention.

In one embodiment, as shown in FIG. 3*e*, the leading edge 240 is rounded. In particular, structural metal 228 is enveloped by an elastomer coating (or liner) 230, which is also rounded at its leading edge, and the wear material 242 is embedded therein. Because of the rounded edges, there is reduced stress concentration that results from the rock impact and screen vibration. This reduced stress allows for better resistance to tear/delamination and overall resistance to harsh operating conditions and, consequently, longer life.

The screen cloth 210 may be easily fabricated by molding or casting. Briefly, wear material 242 is temporarily affixed onto the mold. Elastomer coating (or liner) 230 is then filled into the annulus of the mold. Since the bonding between wear material 242 and elastomer coating (or liner) 230 is critical, wear material 242 may need to be surface prepared to ensure the proper surface profile or primer/adhesive may be required to provide suitable adhesion.

It is understood that multiple of these screen cloths 210 will be installed in a vibrating, rotating or stationary screening device's main cross members to form the screening deck (also referred to herein simply as the screen) of the vibrating or stationary screening device. Screen cloths 210 can be attached to the main cross members by means of bolts inserted through bolt holes. In one embodiment, the screen may include a feed end and a discharge end, and a plurality of screening rows positioned end to end between the feed end and the discharge end, with each screening row comprising one or more screen cloths 210 of the present invention.

The oil sand slurry having oversize reject material is screened by feeding the oil sand slurry onto the screen so that the slurry flows in the direction of the longitudinal ligaments and allows the oversize reject material to pass over the screen cloth 210. Since the wear material 242 and elastomer coating (or liner) 230 together form a protective surface, the screen cloth 210 can withstand the abrasiveness of the oil sand slurry and exhibits a considerably longer service life compared to those of prior art screen cloths.

The previous description of the disclosed embodiments is provided to enable any person skilled in the art to make or use the present invention. Various modifications to those embodiments will be readily apparent to those skilled in the art, and the generic principles defined herein may be applied to other embodiments without departing from the spirit or scope of the invention. Thus, the present invention is not intended to be limited to the embodiments shown herein, but is to be accorded the full scope consistent with the claims, wherein reference to an element in the singular, such as by use of the article "a" or "an" is not intended to mean "one and only one" unless specifically so stated, but rather "one or more". All structural and functional equivalents to the elements of the various embodiments described throughout the disclosure that are known or later come to be known to those of ordinary skill in the art are intended to be encompassed by the elements of the claims. Moreover, nothing disclosed herein is intended to be dedicated to the public regardless of whether such disclosure is explicitly recited in the claims.

We claim:

1. A screen cloth having an impact face for use in a screening device for screening out oversize objects in a material flowing in a direction, comprising:

a metal plate having a perimeter and comprising a plurality of openings therethrough and forming a grid having longitudinal ligaments substantially parallel to the direction of the material flow and transverse ligaments substantially perpendicular to the direction of the material flow, the metal plate having an impact surface and a bottom surface;

a coating or liner comprising an elastomer, coating or lining at least the impact surface of the metal plate or a portion thereof; and a wear material partially embedded into the elastomer coating or liner at a leading edge of the at least one transverse ligament relative to the direction of the material flow, such that a portion of the wear material is exposed on the impact face of the screen cloth to prevent the elastomer at the leading edge from tearing or gouging by the flow of the material.

2. The screen cloth of claim 1, wherein the plate comprises a front edge, a back edge, a first side edge, and a second side edge.

3. The screen cloth of claim 2, wherein the longitudinal ligaments extend from the front edge to the back edge.

4. The screen cloth of claim 3, wherein the transverse ligaments extend from the first side edge to the second side edge.

5. The screen cloth of claim 4, wherein the metal plate is made of structural steel.

6. The screen cloth of claim 5, wherein the openings are equally sized.

7. The screen cloth of claim 6, wherein the openings are rectangular.

8. The screen cloth of claim 1, wherein the elastomer coating or liner coats or lines the portion of the impact surface of the metal plate prone to wear.

9. The screen cloth of claim 1, wherein the elastomer coating or liner coats or lines both the impact surface and the bottom surface of the metal plate.

10. The screen cloth as claimed in claim 1, wherein the elastomer coating or liner coats or lines the entirety of the metal plate.

11. The screen cloth of claim 1, wherein the elastomer is selected from synthetic or natural rubber, polyurethane, a thermosetting elastomer, or a thermoplastic elastomer.

12. The screen cloth as claimed in claim 1, wherein the leading edge is located on a portion of the at least one transverse ligament that is positioned between two side by side longitudinal ligaments.

13. The screen cloth of claim 1, wherein the wear material is selected from chromium carbide, tungsten carbide, ceramic, tungsten carbide/steel composite, or sintered tungsten carbide.

14. The screen cloth of claim 13, wherein the wear material is in the form of a rod, cylinder, sphere, tile, insert, segment or combinations thereof.

15. The screen cloth of claim 14, wherein the wear material is in the form of one piece or multiple pieces of tile.

16. The screen cloth of claim 14, wherein the wear material is in the form of at least one segment having an "L" or "C" shape.

17. The screen cloth of claim 2, wherein a front wall of the screen opening is angled downwardly and outwardly relative to the front edge.

18. The screen cloth as claimed in claim 17, wherein a corner of the leading edge of the structural metal is machined out to have a thicker elastomer coating or liner between the structural metal and the wear material.

19. A screen for use in a vibrating, rotating or stationary screening device, the screen having a feed end and a discharge end, for screening oversize objects in a material is provided, comprising:

a plurality of screening rows positioned end to end between the feed end and the discharge end, each screening row comprising one or more screen cloths of claim 1.

20. A method for screening an oil sand slurry having oversize reject material, comprising:

providing a screen having a number of screen cloths, each screen cloth having an impact face and comprising a metal plate having a perimeter and comprising a plurality of openings therethrough and forming a grid having longitudinal ligaments substantially parallel to the direction of the material flow and transverse ligaments substantially perpendicular to the direction of the material flow, the metal plate having an impact surface and a bottom surface; a coating or lining comprising an elastomer, coating or lining at least the impact surface of the metal plate or a portion thereof; and a wear material partially embedded into the elastomer coating or liner at a leading edge of the at least one transverse ligament relative to the direction of the material flow, such that a portion of the wear material is exposed on the impact face of the screen cloth to prevent the elastomer at the leading edge from tearing or gouging by the flow of the material; and feeding the oil sand slurry onto the screen so that the slurry flows in the direction of the longitudinal ligaments and allows the oversize reject material to pass over the screen cloth.

* * * * *